US006911630B2

(12) United States Patent
Neckel

(10) Patent No.: US 6,911,630 B2
(45) Date of Patent: Jun. 28, 2005

(54) AIR HEATER

(75) Inventor: Klaus Neckel, Spielberg (DE)

(73) Assignee: Beru AG, Ludwigsburg (DE)

( * ) Notice: Subject to any disclaimer, the term of this patent is extended or adjusted under 35 U.S.C. 154(b) by 531 days.

(21) Appl. No.: 09/879,080

(22) Filed: Jun. 13, 2001

(65) Prior Publication Data

US 2001/0052518 A1 Dec. 20, 2001

(30) Foreign Application Priority Data

Jun. 14, 2000 (DE) ..... 100 28 446
Feb. 15, 2001 (JP) ..... 2001-038220

(51) Int. Cl.[7] ..... H05B 1/02
(52) U.S. Cl. ..... 219/505
(58) Field of Search ..... 219/505, 504, 219/501, 482, 483, 488, 490, 494; 338/22, 20, 21; 361/161, 164; 392/485, 486

(56) References Cited

U.S. PATENT DOCUMENTS 4,196,338 A * 4/1980 Edel ..... 219/203
4,237,366 A * 12/1980 Berg ..... 219/219
4,506,137 A * 3/1985 Meister ..... 219/203
4,716,279 A 12/1987 Hori et al.
5,598,502 A 1/1997 Takahashi et al.
6,320,159 B1 11/2001 Topp
6,410,886 B1 * 6/2002 Julien ..... 219/213

FOREIGN PATENT DOCUMENTS

DE 19751423 * 11/1997 ..... H05B/3/84
DE 197 38 318 A1 3/1999
DE 198 48 169 A1 5/1999
DE 197 51 423 A1 6/1999
EP 0 554 459 A1 8/1993

* cited by examiner

*Primary Examiner*—Daniel Robinson
(74) *Attorney, Agent, or Firm*—Nixon Peabody LLP; David S. Safran

(57) ABSTRACT

Air heater with PTC heating element with semiconductor switch, the semiconductor switch (5) without the housing being located in the heating tube (9) in the immediate vicinity of the PTC heating element (15).

4 Claims, 2 Drawing Sheets

AIR HEATER

The invention relates to an air heater.

DESCRIPTION OF RELATED ART

Air heaters with PTC heating elements which are pushed into the air conditioning box of a motor vehicle and which are connected to a semiconductor switch are known.

Standardized HL switches are installed in their own housing, the switches being located at a great spatial distance to the coolant. Power loss in the form of heat occurs due to the internal resistance of the HL switch. It is conventional to route this power loss at the same time into the medium which is to be heated by the heating element. As a result of the great spatial distance numerous material transitions occur over long transport distances so that overall the heat transfer resistance is relatively great. For these reasons high-power HL switches must be used.

SUMMARY OF THE INVENTION

The object of the invention is to make available air heaters, circumventing the indicated defects, in which the heat transfer resistance is improved between the HL switch and the coolant, i.e. reduced, with the objective of being able to use lower power HL switches.

The object of the invention is achieved by the air heater as described below; while other advantageous embodiments of the air heater of the invention are evident from the drawings.

One important aspect is to use only a switch chip, not a standardized HL switch in its own housing. By placing this chip (only the silicon board) directly in the heating element the power loss can be drained directly into the coolant. Additional heat conductors are not needed. Installation is simple.

In addition, lower power HL switches can be used. At the same time the heat loss of the HL switch is dissipated completely as heat output to the medium to be heated (conventionally air).

By integration of the HL switch directly into the heat sink of the heating element the heat transfer between the switch and coolant is clearly reduced, the space required for the HL switch is clearly reduced and the mechanical structure of the heating element with electronic triggering is made more favorable in terms of production technology and cost.

The invention is detailed using the following FIGS. 1 to 5.

DETAILED DESCRIPTION OF THE INVENTION

Figure 1:
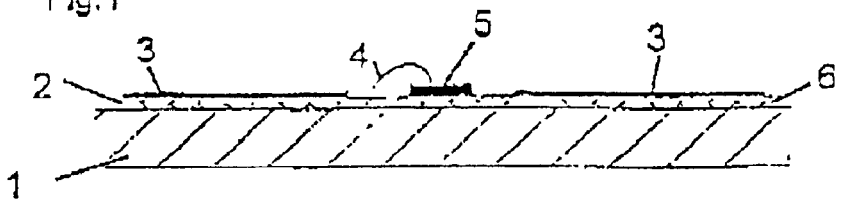
FIG. 1 is a schematic lengthwise section through the unit of the invention with a carrier material, HL chip and contact-making surfaces.
Figure 2:
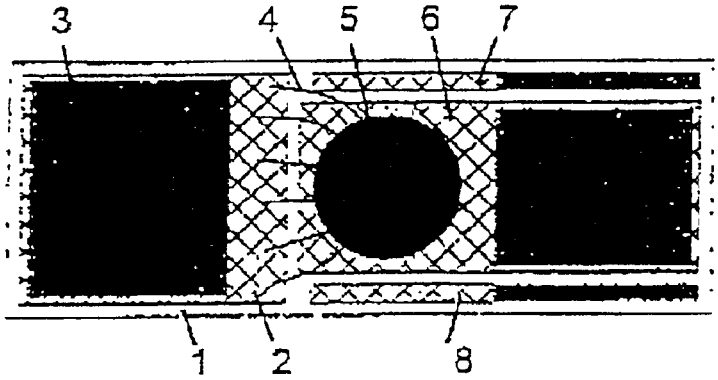
FIG. 2 shows a top view of the unit as shown in FIG. 1.

As shown in FIGS. 1 and 2 a HL switch chip 5 (only the silicon board) is used. The chip 5 is applied to a good heat conductor 6 (preferably copper). From there it is connected to the current output path 2 which makes contact with the PTC elements (ceramic) which yield the actual heat output; a further connection takes place to the control pad 7 and the diagnosis pad 8, the connection taking place preferably in bond technology. All these pads are good heat conductors, preferably copper, in order to be able to efficiently dissipate the heat introduced via connecting lines if necessary.

The pads are applied to an electrically nonconductive heat conductor 1 which preferably consists of ceramic.

A contact material 3 is applied to the pads and it ensures that the thermal and electrical contact resistance to the contact strips 10, which leads to the battery terminal, 11, which leads to the heating element, 13 (for the control pad 7), 14 (for diagnosis pad 8) are minimized accordingly.

Figure 4:
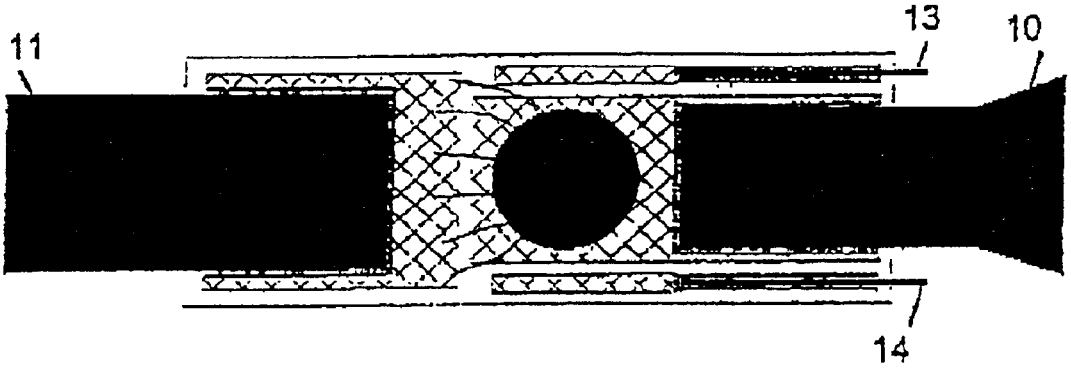
FIG. 4 shows a top view of the unit as shown in FIG. 2 with the contacts in place.

As shown in FIG. 4 contact strips 10, 11, 13 which as control strips and 14, which is made as diagnosis strips, which are made of a good heat conductor, preferably copper, are placed over the pads 2, 6, 7, 8 (see FIG. 2).

This modular version is shown schematically as a top view in FIG. 2; here the formation of the current output pad 2 with the overlying contact material 3 is shown; the chip 5 is connected to the output pad 2, the control pad 7 and the diagnosis pad 8 which for their part are each occupied by contact material 3.

Figure 3:
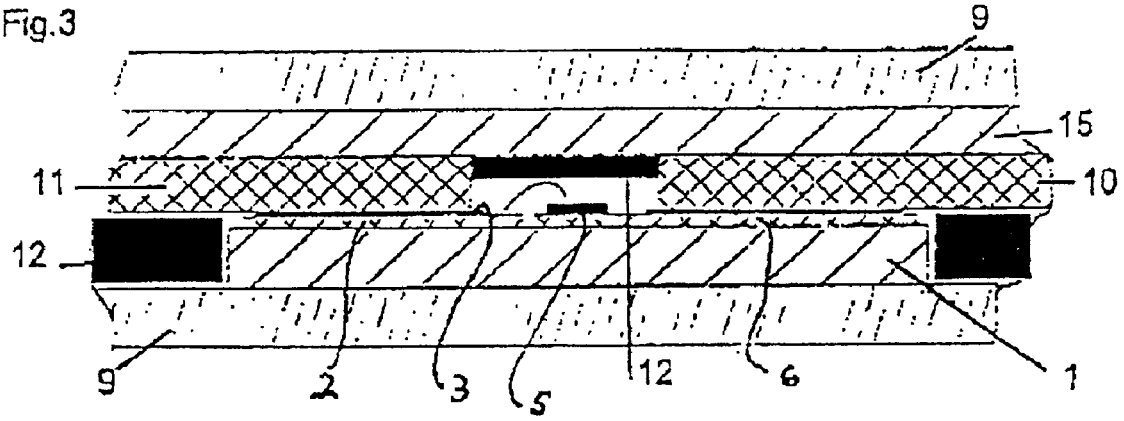
FIG. 3 is a schematic lengthwise section through the heating element with an integrated unit of the invention.

As shown in FIG. 3, the contact strips 10, 11, 13, 14 are placed on the contact material 3 via the pads 2, 6, 7, and 8, the installation of the module taking place by means of a frame 12; here it becomes clear that as a cover which closes to the top another electrically nonconductive heat conduction layer (ceramic) 15 rests on the contact strips 10/11, 13, 14. The modular unit is then placed in the heating rod 9 and pressed so that good heat transfer is ensured.

FIG. 4 finally shows as a schematic top view the modular unit with the contacts in place, the reference numbers having the aforementioned meaning.

Figure 5:
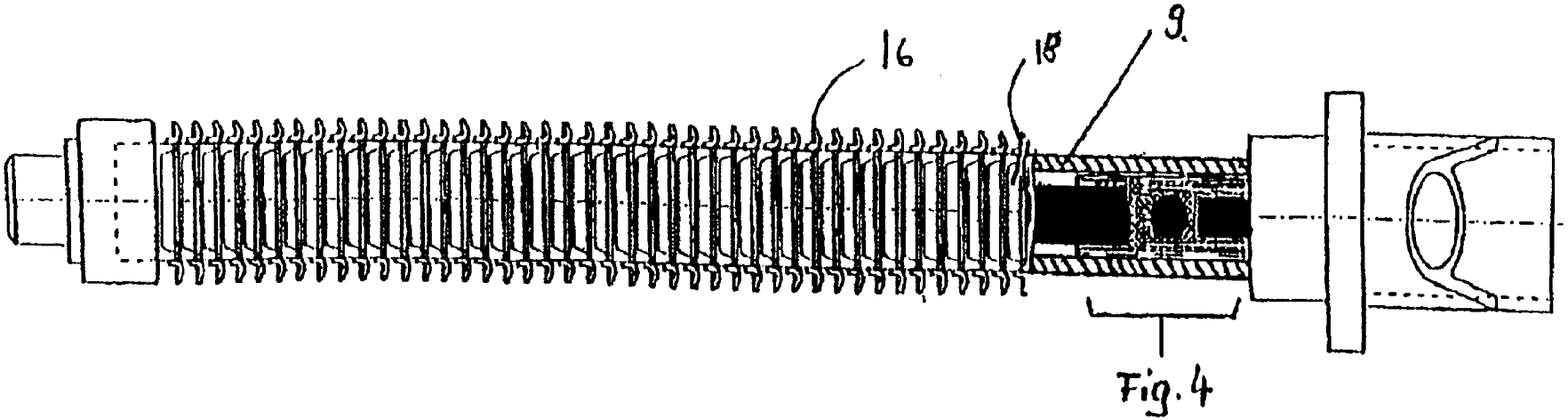
FIG. 5 shows a schematic lengthwise section through one embodiment of an air heater of the invention.

FIG. 5 schematically shows one embodiment of an air heater of the invention, the modular unit being located within the aluminum tube 9 on its terminal-side area and being connected directly to the adjacent PTC healing elements 18; the heat output of the HL switch module and PTC elements 18 is dissipated to the environment via plates 16.

What is claimed is:

1. Air heater with PTC heating elements comprising:

a unit which includes PTC heating elements, a semiconductor switch having a semiconductor chip without a housing, and a heating tube, wherein said semiconductor chip (5) without a housing is located uncovered so as to be exposed in a space within said heating tube (9) in the immediate vicinity of the PTC heating elements (15).

2. Air heater as claimed in claim 1, wherein the unit includes electrically nonconductive heat conductors (1, 15) which cover the semiconductor chip (5), pertinent contact strips (10), (11), (13), (14), a current output pad (2), a control pad (7), and a diagnosis pad (8).

3. Air heater as claimed in claim 2, wherein the semiconductor chip (5) without a housing is applied to a heat-conductive plate (6);

wherein the chip (5) is connected to the current output pad (2), to the control pad (7) and to the diagnosis pad (8), the pads being supported on an electrically nonconductive heat conductor (1), a contact material (3) being applied to the pads and on which rest the contact strip (11) to the FTC heating clement, the contact strip (10)

to the battery (13) and the contact strip (14) to the diagnosis pad (8).

4. Modular unit for connection of air heaters, wherein an HL switch chip (5) is applied without a housing to a heat-conductive plate (6), the HL switch chip being uncovered so as to be exposed in a space within the module unit;

wherein the HL switch chip (5) is connected to a current output path (2), to a control pad (7) and to a diagnosis pad (8), the pads being supported on an electrically nonconductive heat conductor (1), and a contact material (3) being applied to the pads on which rest a contact strip (11) to the PTC heating element, a contact strip (10) to a battery (13) and a contact strip (14) to a diagnosis pad (8).

* * * * *